US009920478B2

(12) United States Patent
Murayama et al.

(10) Patent No.: US 9,920,478 B2
(45) Date of Patent: Mar. 20, 2018

(54) SHEET MANUFACTURING APPARATUS AND SHEET MANUFACTURING METHOD

(71) Applicant: SEIKO EPSON CORPORATION, Tokyo (JP)

(72) Inventors: Yoshiaki Murayama, Shiojiri (JP); Nobuhito Takahashi, Shiojiri (JP); Seiichi Taniguchi, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/840,942

(22) Filed: Aug. 31, 2015

(65) Prior Publication Data

US 2016/0069023 A1 Mar. 10, 2016

(30) Foreign Application Priority Data

Sep. 5, 2014 (JP) ..... 2014-180857
Dec. 2, 2014 (JP) ..... 2014-243669

(51) Int. Cl.
*D21F 13/10* (2006.01)
*D21F 7/00* (2006.01)
*D04H 1/00* (2006.01)

(52) U.S. Cl.
CPC ..... *D21F 13/10* (2013.01); *D04H 1/00* (2013.01); *D21F 7/00* (2013.01)

(58) Field of Classification Search
CPC .. D21F 13/10; D21F 7/00; D04H 1/00; B65H 2515/10; B65H 2601/22
USPC ..... 156/64, 363, 364, 378; 271/3.06, 3.09, 271/3.13
See application file for complete search history.

(56) References Cited

U.S. PATENT DOCUMENTS 4,801,135 A * 1/1989 Povio ..... B65H 1/18 271/155
5,183,240 A * 2/1993 Morooka ..... G03G 15/60 271/258.03
5,248,137 A * 9/1993 Rabjohns ..... B65H 1/14 271/155
8,882,965 B2 11/2014 Yamagami et al.
2014/0027075 A1* 1/2014 Yamagami ..... D21B 1/08 162/4

FOREIGN PATENT DOCUMENTS

JP 2006-257596 A 9/2006
JP 2011-157657 A 8/2011
JP 2012-077415 A 4/2012
JP 2012-144819 A 8/2012

* cited by examiner

*Primary Examiner* — George Koch
(74) *Attorney, Agent, or Firm* — Workman Nydegger

(57) ABSTRACT

A sheet manufacturing apparatus according to the invention includes: a manufacturing unit which manufactures a sheet; a supplying unit which supplies a mounted material mounted thereon to the manufacturing unit; and a determination unit which determines whether or not to initiate manufacturing of the sheet in a state where the mounted material is mounted on the supplying unit.

12 Claims, 10 Drawing Sheets

SHEET MANUFACTURING APPARATUS AND SHEET MANUFACTURING METHOD

BACKGROUND

1. Technical Field

The present invention relates to a sheet manufacturing apparatus and a sheet manufacturing method.

2. Related Art

In the related art, a sheet manufacturing apparatus for manufacturing a sheet by using a used paper sheet as a raw material is known (for example, refer to JP-A-2012-144819). In the sheet manufacturing apparatus, when supplying the used paper sheet from a supplying unit, it is typical to sense whether or not the used paper sheet is in the supplying unit (for example, refer to JP-A-2011-157657).

In the sheet manufacturing apparatus, in order to stabilize a grammage of a manufactured sheet, it is preferable to stabilize an amount of a raw material (for example, a defibrated used paper sheet) which flows in each unit of the sheet manufacturing apparatus. However, for example, since the amount of the raw material gradually increases up to approximately 20 (the number of supplied used paper sheets is approximately 20) from the time when the supply of the used paper sheet is started, the amount of the raw material which flows in each unit of the sheet manufacturing apparatus is not stabilized. In this state, for example, even when manufacturing a sheet by loading 15 used paper sheets onto the supplying unit, there is a case where it is not possible to manufacture a sheet having desired characteristics.

SUMMARY

An advantage of some aspects of the invention is to provide a sheet manufacturing apparatus which can manufacture a sheet having desired characteristics. In addition, another advantage of some aspects of the invention is to provide a sheet manufacturing method which can manufacture a sheet having desired characteristics.

The invention can be realized in the following forms or application examples.

According to an aspect of the invention, there is provided a sheet manufacturing apparatus, including: a manufacturing unit which manufactures a sheet; a supplying unit which supplies a mounted material mounted thereon to the manufacturing unit; and a determination unit which determines whether or not to initiate manufacturing of the sheet in a state where the mounted material is mounted on the supplying unit.

In the sheet manufacturing apparatus, in a state where the mounted material is mounted on a loading unit of the supplying unit, it is possible to judge not to initiate the manufacturing of the sheet. Therefore, in the sheet manufacturing apparatus, it is possible to suppress that the sheet having desired characteristics cannot be manufactured. Accordingly, the sheet manufacturing apparatus can manufacture the sheet having desired characteristics.

In the sheet manufacturing apparatus according to the aspect of the invention, a sensing unit which can recognize that an amount of the mounted material is equal to or less than a ratio set in advance with respect to a maximum mounting amount of the supplying unit at a plurality of points where the amount is equal to or less than the ratio set in advance, may be further provided.

In the sheet manufacturing apparatus, it is possible to determine not to initiate the manufacturing of the sheet when it is recognized that the amount of the mounted material is equal to or less than the ratio set in advance. For this reason, it is possible to ascertain that the sheet cannot be stably (for example, with a stabilized grammage) manufactured.

In the sheet manufacturing apparatus according to the aspect of the invention, the determination unit may determine not to initiate the manufacturing of the sheet when initiation of the manufacturing of the sheet is commanded or before the manufacturing is initiated in a state where the mounted material is mounted on the supplying unit.

In the sheet manufacturing apparatus, it is possible to determine not to manufacture the sheet when the initiation of the manufacturing of the sheet is commanded or before the manufacturing is initiated. For this reason, after initiating the manufacturing (for example, after a crushing unit crushes the mounted material), the manufacturing does not stop immediately, and thus, it is possible to suppress that the mounted material becomes wasted.

According to the aspect of the invention, the supplying unit may supply a cut-form raw material, and the manufacturing unit may be provided with a crushing unit which crushes the raw material.

In the sheet manufacturing apparatus, before the crushing unit crushes the raw material, the determination unit judges whether or not to initiate the manufacturing of the sheet. For example, when the judging is performed after the crushing unit crushes the raw material, there is a case where it is difficult for a user to recognize that the raw material flows up to which part of each unit of the sheet manufacturing apparatus. In the sheet manufacturing apparatus, it is possible to avoid the above-described problem.

According to another aspect of the invention, there is provided a sheet manufacturing method, including: determining whether or not to initiate manufacturing of a sheet by a determination unit in a state where a mounted material is mounted on a supplying unit; supplying the mounted raw material to a manufacturing unit; and manufacturing the sheet by using the supplied mounted material.

In the sheet manufacturing method, it is possible to manufacture a sheet having desired characteristics.

According to still another aspect of the invention, there is provided a sheet manufacturing apparatus, including: a manufacturing unit which manufactures a sheet; a supplying unit which supplies a mounted material mounted thereon to the manufacturing unit; and a command unit which commands manufacturing of the sheet, in which there is a case where the mounted material is not supplied when the command of manufacturing from the command unit is received in a state where the mounted material is mounted on the supplying unit.

In a sheet manufacturing apparatus in the related art, in a state where the mounted material is mounted, there is not a case where the mounted material is not supplied. Meanwhile, in the sheet manufacturing apparatus of the specification, there is a case where the mounted material is not supplied. Therefore, in the sheet manufacturing apparatus of the specification, it is possible to manufacture the sheet having desired characteristics.

In the sheet manufacturing apparatus according to the aspect of the invention, an output unit which performs outputting of an instruction (information) that the mounted material is not supplied, may be further provided.

In the sheet manufacturing apparatus, the user can ascertain that the supplying unit does not supply the mounted material.

In the sheet manufacturing apparatus according to the aspect of the invention, an output unit which outputs an instruction (information) on how many mounted materials are supposed to be additionally mounted to initiate the manufacturing of the sheet, may be further provided.

In the sheet manufacturing apparatus, the user can ascertain how many mounted materials are supposed to be additionally mounted to initiate the manufacturing of the sheet.

In the sheet manufacturing apparatus according to the aspect of the invention, the output unit may perform outputting of an instruction (information) on how many mounted materials are supposed to be additionally mounted to initiate supply of the sheet.

In the sheet manufacturing apparatus, the user can ascertain how many mounted materials are supposed to be additionally mounted to initiate the supply of the sheet.

In the sheet manufacturing apparatus according to the aspect of the invention, an instruction (indicator) which shows a reference of a loading amount of the mounted material which is necessary for initiating the manufacturing of the sheet may be described (indicated) in the supplying unit.

In the sheet manufacturing apparatus, the user can ascertain the loading amount of the mounted material which is necessary for initiating the manufacturing of the sheet.

In the sheet manufacturing apparatus according to the aspect of the invention, an instruction (indicator) which shows a reference of a loading amount of the mounted material which is necessary for initiating the supply of the mounted material may be described (indicated) in the supplying unit.

In the sheet manufacturing apparatus, the user can ascertain the loading amount of the mounted material which is necessary for initiating the supply of the mounted material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, appropriate embodiments of the invention will be described in detail with reference to the drawings. In addition, the embodiments which will be described hereinafter do not inappropriately limit the content of the invention which is described within a range of aspects of the patent. In addition, all of configurations which will be described hereinafter are not necessarily essential conditions of the invention.

First Embodiment

1. Sheet Manufacturing Apparatus 1.1. Configuration

Figure 1:
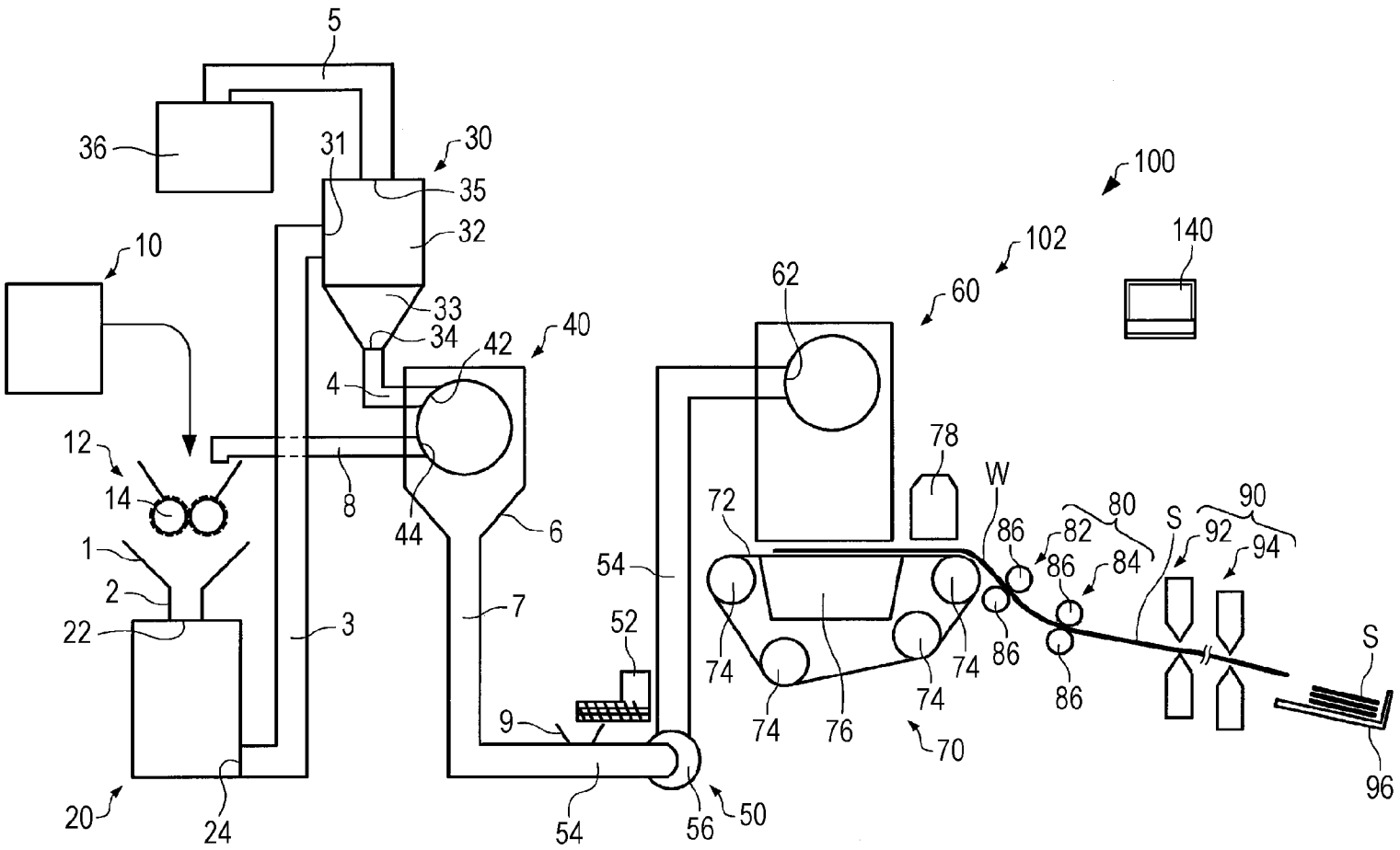
FIG. 1 is a schematic view illustrating a sheet manufacturing apparatus according to a first embodiment.

First, a sheet manufacturing apparatus according to a first embodiment will be described with reference to the drawings. FIG. 1 is a schematic view illustrating a sheet manufacturing apparatus 100 according to the first embodiment.

As illustrated in FIG. 1, the sheet manufacturing apparatus 100 includes a supplying unit 10, a manufacturing unit 102, and a control unit 140. The manufacturing unit 102 manufactures a sheet. The manufacturing unit 102 includes a crushing unit 12, a defibrating unit 20, a classifying unit 30, a screening unit 40, a mixing unit 50, a deposition unit 60, a web forming unit 70, a sheet forming unit 80, and a cutting unit 90.

The supplying unit 10 supplies a raw material to the crushing unit 12. The supplying unit 10 is, for example, an automatic input unit for continuously inputting the raw material to the crushing unit 12. The raw material which is supplied by the supplying unit 10 includes, for example, fibers, such as a used paper sheet or a pulp sheet.

In addition, a detailed configuration or the like of the supplying unit 10 will be described later. In addition, the control unit 140 which controls the supplying unit 10 also will be described later in detail.

The crushing unit 12 cuts and makes the raw material which is supplied by the supplying unit 10 into small pieces in the air. The shape and the size of the small pieces are several cm square, for example. In the example illustrated in the drawing, the crushing unit 12 includes a crushing blade 14, and it is possible to cut the input raw material by the crushing blade 14. As the crushing unit 12, it is possible to use a shredder, for example. The raw material which is cut by the crushing unit 12 is carried (transported) to the defibrating unit 20 via a pipe 2 after being received by a hopper 1.

The defibrating unit 20 defibrates the raw material which is cut by the crushing unit 12. Here, "defibrate" means untangling the fibers in the raw material (defibration object) which is made by bonding together a plurality of fibers one by one. The defibrating unit 20 has a function of separating materials, such as resin grains, ink, toner, or a blur-preventing agent, which are attached to the raw material from the fibers.

The material which passes through the defibrating unit 20 is called a "defibrated material". There is also a case where examples of the "defibrated material" include resin (resin for bonding together a plurality of fibers to each other) grains which are separated from the fibers when untangling the fibers, a coloring agent, such as ink and toner, or an additive, such as a blur-preventing agent and a paper strengthening agent, in addition to the untangled defibrated fibers. The shape of the untangled defibrated material is a string shape or a ribbon shape. The untangled defibrated material may exist in a state of not being intertwined with other untangled fibers (a state of being independent), or may exist in a state of being intertwined with other untangled defibrated materials in a shape of a mass (a state where so-called "lumps" are formed).

The defibrating unit 20 performs defibration by a dry method in the atmosphere (in the air). Specifically, as the defibrating unit 20, for example, an impeller mill is used. The defibrating unit 20 has a function of generating an airflow to suck the raw material and discharge the defibrated material. Accordingly, the defibrating unit 20 can suck the raw material together with the airflow from an introduction port 22, perform defibration processing, and transport the defibrated material to a discharge port 24, by the airflow which is generated from the defibrating unit 20 itself. The defibrated material which passes through the defibrating unit 20 is transported to the classifying unit 30 via a pipe 3.

The classifying unit 30 classifies the defibrated material which passes through the defibrating unit 20. Specifically, the classifying unit 30 separates and removes a defibrated material (resin grains, coloring agent, additive, or the like) which has a relatively small size or a relatively low density among the defibrated materials. Accordingly, it is possible to increase a proportion of fibers which has a relatively large size or a relatively high density among the defibrated materials.

As the classifying unit 30, an airflow classifier is used. The airflow classifier generates a swirling airflow and performs separation in accordance with a difference between centrifugal forces received according to the size and the density of the classified materials. By adjusting the speed of the airflow and the centrifugal force, it is possible to adjust a classification point. Specifically, as the classifying unit 30, a cyclone, an elbow jet, or an Eddy classifier, is used. In particular, since the cyclone described in the drawing has a simple structure, it is possible to appropriately use the cyclone as the classifying unit 30.

The classifying unit 30 includes, for example, an introduction port 31, a cylinder unit 32 to which the introduction port 31 is connected, an inverse cone unit 33 which is positioned below the cylinder unit 32 and continues to the cylinder unit 32, a lower discharge port 34 which is provided in the center of a lower part of the inverse cone unit 33, and an upper discharge port 35 which is provided in the center of an upper part of the cylinder unit 32.

In the classifying unit 30, the airflow which has the defibrated material introduced from the introduction port 31 therein changes its directions of flow into a circumferential movement by the cylinder unit 32. Accordingly, the centrifugal force is applied to the introduced defibrated material, and the classifying unit 30 can separate the fibers (first classified material) having a larger size and a higher density than that of resin grains or ink grains in the defibrated material, or resin grains, a coloring agent, or an additive (second classified material) which have a smaller size and a lower density than that of the fibers in the defibrated material. The first classified material is discharged from the lower discharge port 34 and introduced to the screening unit 40 via a pipe 4. Meanwhile, the second classified material is discharged to a receiving unit 36 via a pipe 5 from the upper discharge port 35.

The screening unit 40 introduces the first classified material which passes through the classifying unit 30 from an introduction port 42, and performs screening according to the length of the fibers. As the screening unit 40, for example, a sieve is used. The screening unit 40 includes a net (filter and screen), and can divide fibers or grains (first screened material which passes through the net) which are included in the first classified material and are smaller than an aperture of the net, and fibers, undefibrated pieces, or lumps (second screened material which does not pass through the net) which is greater than the aperture of the net. For example, the first screened material is carried to the mixing unit 50 via a pipe 7 after being received by a hopper 6. The second screened material returns to the defibrating unit 20 via a pipe 8 from a discharge port 44. Specifically, the screening unit 40 is a cylindrical sieve which can be rotated by a motor. The net of the screening unit 40 uses, for example, mesh, an expandable metal which is made by expanding a metal plate having a notch, and a punching metal which has holes formed by a press machine or the like on the metal plate.

The mixing unit 50 mixes the first screened material which passes through the screening unit 40, and an additive agent which includes a resin. The mixing unit 50 includes an additive agent supplying unit 52 which supplies the additive agent, a pipe 54 which transports the screened material and the additive material, and a blower 56. In the example illustrated in the drawing, the additive material is supplied to the pipe 54 via a hopper 9 from the additive agent supplying unit 52. The pipe 54 continues to the pipe 7.

In the mixing unit 50, it is possible to transport the first screened material and the additive material while generating an airflow by the blower 56 and mixing the first screened material and the additive material in the pipe 54. In addition, a mechanism which mixes the first screened material and the additive material is not particularly limited, may be a mechanism which performs stirring by an impeller blade which rotates quickly, and may be a mechanism which uses the rotation of a container, such as a V-type mixer.

As the additive agent supplying unit 52, a screw feeder illustrated in FIG. 1 or a disk feeder which is not illustrated is used. The additive material which is supplied from the additive agent supplying unit 52 includes a resin for bonding a plurality of fibers to each other. At the time when the resin is supplied, the plurality of fibers are not bonded to each other. The resin is melted when passing through the sheet forming unit 80, and bonds the plurality of fibers to each other.

The resin which is supplied from the additive agent supplying unit 52 is a thermoplastic resin or a heat-curable resin, for example, an AS resin, an ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyether ether ketone. These resins may be used independently or by being appropriately mixed. The additive material which is supplied from the additive agent supplying unit 52 may be in the shape of a fiber, or may be a powder-like shape.

In addition, in the additive material which is supplied from the additive agent supplying unit 52, in addition to the resin which bonds the fibers to each other, in accordance with a type of the sheet to be manufactured, a colorant for coloring the fibers, a coagulation preventing material for inhibiting coagulation of the fibers, or a flame retardant for making the fibers difficult to ignite, may be included. A mixed material (mixed material of the first classified material and the additive material) which passes through the mixing unit 50 is carried to the deposition unit 60 via the pipe 54.

The deposition unit 60 introduces the mixed material which passes through the mixing unit 50 from an introduction port 62, untangles the intertwined defibrated material (fibers), and makes the defibrated material fall downwards while being dispersed in the air. Furthermore, when the resin of the additive material which is supplied from the additive agent supplying unit 52 is in a shape of a fiber, the deposition unit 60 untangles the intertwined resin. Accordingly, the deposition unit 60 can deposit the mixed material with high uniformity onto the web forming unit 70.

As the deposition unit 60, a cylindrical sieve which rotates is used. The deposition unit 60 includes a net, and makes the fibers or the grains (materials which pass through the net) which are included in the mixed material that passes through the mixing unit 50 and are smaller than an aperture of the net fall. A configuration of the deposition unit 60 is the same as the configuration of the screening unit 40, for example.

In addition, the "sieve" of the deposition unit 60 may not have a function of screening a specific target. In other words, the "sieve" which is used as the deposition unit 60 means a sieve which is provided with a net, and the deposition unit 60 may make all of the mixed materials which are introduced to the deposition unit 60 fall.

The web forming unit 70 deposits a passed material which passes through the deposition unit 60, and forms a web W. The web forming unit 70 includes, for example, a mesh belt 72, a stretching roller 74, and a suction mechanism 76.

The mesh belt 72 deposits the passed material which passes through an opening (opening of the net) of the deposition unit 60 while moving. The mesh belt 72 is configured to stretch by the stretching roller 74, makes the passed material difficult to pass, and allows the air to pass through. The mesh belt 72 is moved as the stretching roller 74 revolves. While the mesh belt 72 continuously moves, as the passed materials which pass through the deposition unit 60 continuously fall downwards and pile up, the web W is formed on the mesh belt 72. The mesh belt 72 is made of, for example, metal, resin, cloth, or a non-woven fabric.

The suction mechanism 76 is provided below the mesh belt 72 (on a side opposite to the deposition unit 60 side). The suction mechanism 76 can generate an airflow (airflow which is oriented to the mesh belt 72 from the deposition unit 60) which flows downward. By the suction mechanism 76, it is possible to suck the mixed material which is dispersed in the air by the deposition unit 60 on the mesh belt 72. Accordingly, it is possible to increase a discharge speed from the deposition unit 60. Furthermore, by the suction mechanism 76, it is possible to form a downstream flow to a dropping route of the mixed material, and to prevent the defibrated material or the additive material from being intertwined in the middle of being dropped.

As described above, as passing by the deposition unit 60 and the web forming unit 70 (web forming process), the web W which is in a state of having a large amount of air and being swollen is formed. The web W which is deposited on the mesh belt 72 is transported to the sheet forming unit 80.

In addition, in the example illustrated in the drawing, a moisture-adjusting unit 78 which adjusts moisture of the web W is provided. The moisture-adjusting unit 78 adds water or vapor to the web W, and can adjust a quantity ratio between the web W and the water.

The sheet forming unit 80 heat-pressurizes the web W which is deposited on the mesh belt 72, and forms a sheet S. In the sheet forming unit 80, by applying heat to the mixed material of the defibrated material and the additive material that are mixed in the web W, it is possible to bond the plurality of fibers in the mixed material to each other via the additive material (resin).

As the sheet forming unit 80, for example, a heating roller (heater roller), a heat press forming machine, a hot plate, a warm air blower, an infrared heater, or a flash fixing device, is used. In the example illustrated in the drawing, the sheet forming unit 80 is provided with a first bonding unit 82 and a second bonding unit 84, and the bonding units 82 and 84 are respectively provided with one pair of heating rollers 86. As the bonding units 82 and 84 are configured as the heating rollers 86, compared to a case where the bonding units 82 and 84 are configured as a press apparatus (flat plate press apparatus) in a shape of a plate, it is possible to form the sheet S while continuously transporting the web W. In addition, the number of the heating rollers 86 is not particularly limited.

The cutting unit 90 cuts the sheet S which is formed by the sheet forming unit 80. In the example illustrated in the drawing, the cutting unit 90 includes a first cutting unit 92 which cuts the sheet S in a direction which intersects with a transporting direction of the sheet S, and a second cutting unit 94 which cuts the sheet S in a direction which is parallel to the transporting direction. The second cutting unit 94 cuts, for example, the sheet S which passes through the first cutting unit 92.

As described above, a cut-form sheet S having a predetermined size is formed. The cut cut-form sheet S is discharged to a discharge unit 96.

1.2. Supplying Unit

Figure 2:
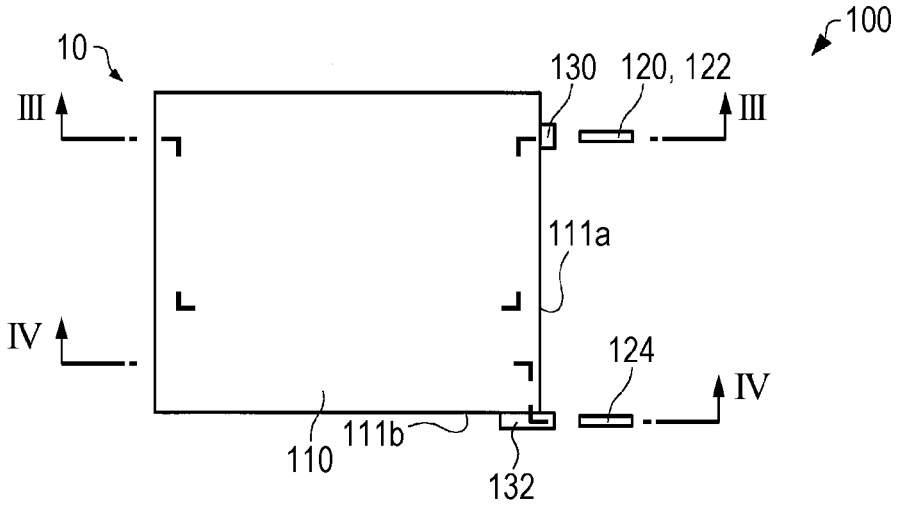
FIG. 2 is a schematic plan view illustrating the sheet manufacturing apparatus according to the first embodiment.
Figure 3:
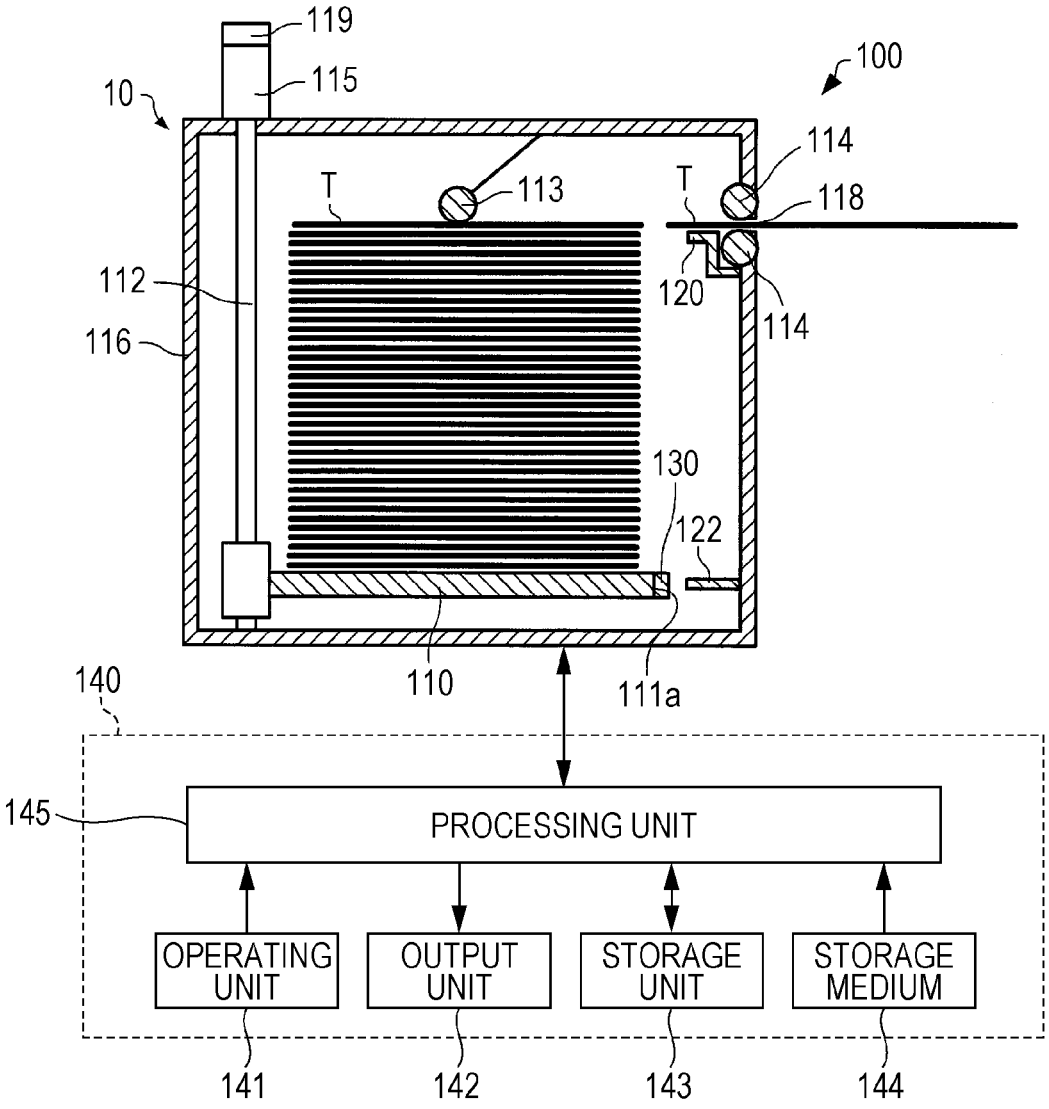
FIG. 3 is a view illustrating a supplying unit and a control unit of the sheet manufacturing apparatus according to the first embodiment.
Figure 4:
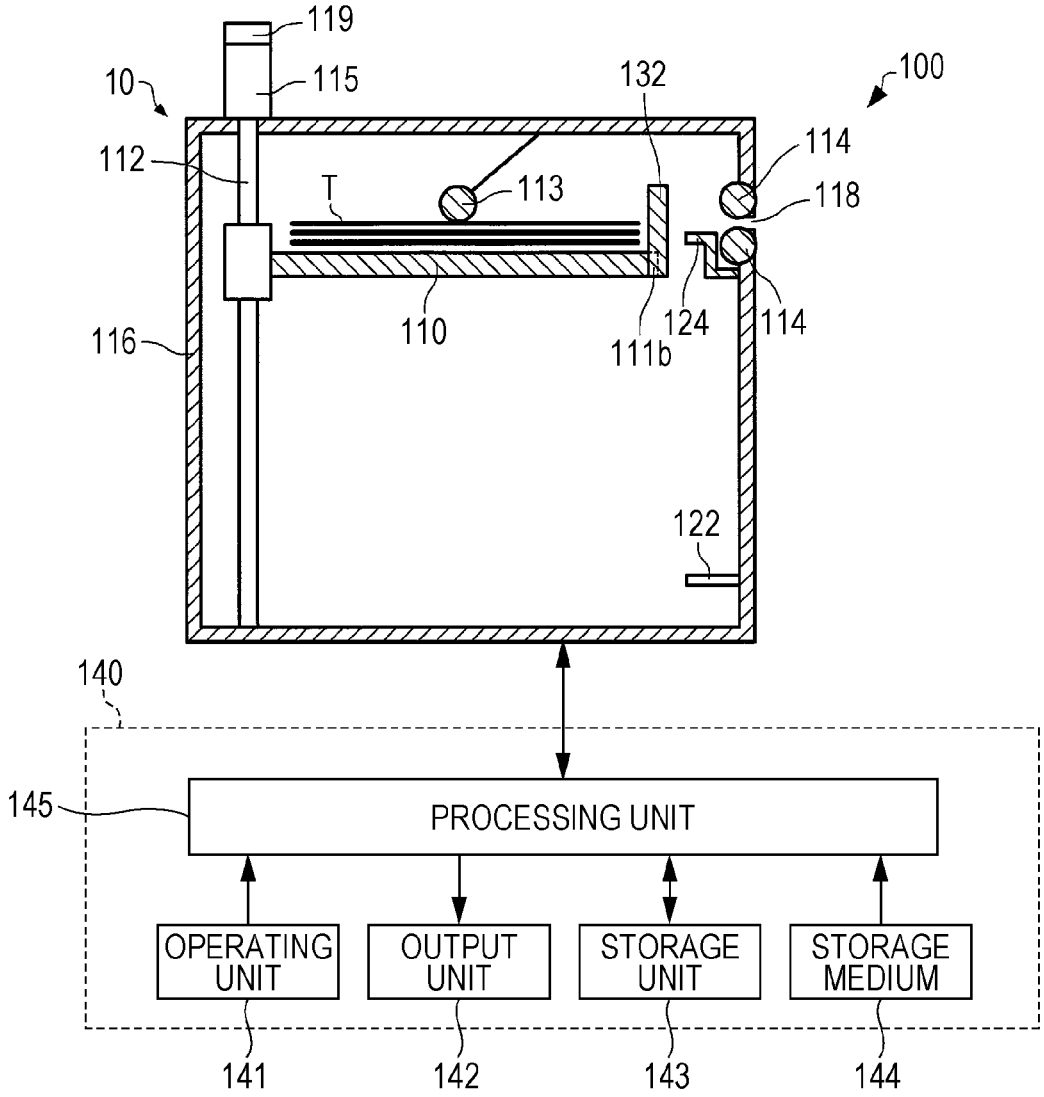
FIG. 4 is a view illustrating the supplying unit and the control unit of the sheet manufacturing apparatus according to the first embodiment.

The supplying unit 10 of the sheet manufacturing apparatus 100 will be described in detail. FIG. 2 is a schematic view illustrating the supplying unit 10. FIGS. 3 and 4 are schematic views illustrating the supplying unit 10. In addition, for convenience, in FIG. 2, parts except for a loading unit 110, sensors 120, 122, and 124, and detection target units 130 and 132 are omitted. In addition, the loading unit 110, the sensors 120 and 122, and the first detection target unit 130, which are illustrated in FIG. 3, are schematically illustrated by a cross section along line III-III of FIG. 2. In addition, the loading unit 110, the third sensor 124, and the second detection target unit 132, which are illustrated in FIG. 4, are schematically illustrated by a cross section along line IV-IV of FIG. 2. In addition, in FIGS. 3 and 4, functional block diagrams of the control unit 140 are illustrated. In addition, in FIG. 3, a state where the second sensor 122 detects the first detection target unit 130 is illustrated, and in FIG. 4, a state where the third sensor 124 detects the second detection target unit 132 is illustrated.

As illustrated in FIGS. 2 to 4, the supplying unit 10 supplies a mounted material (raw material) T mounted thereon to the manufacturing unit 102. Specifically, the supplying unit 10 supplies the cut-form mounted material (raw material) T to the crushing unit 12. The crushing unit 12 crushes the mounted material T which is supplied by the supplying unit 10. In addition, the cut-form means, for example, a state where the mounted material is cut one by one into an A3 size, an A4 size, or a letter size, similarly to a printer paper sheet which is available in the market. In addition, although not illustrated in the drawing, the supplying unit 10 may supply pulp in a rolled shape to the crushing unit 12. The mounted material T is mounted on the loading unit 110 by a user.

The supplying unit 10 includes the loading unit 110 inside a housing 116. The mounted material T is mounted (loaded) on the loading unit 110. A pickup roller 113 abuts against the uppermost mounted material T among the mounted materials T. As the pickup roller 113 rotates, the uppermost mounted material T is transported to the right side of FIG. 3. The transported mounted material T is transported to the crushing unit 12 from an extracting port 118 which is provided in the housing 116 by a feeding roller 114. Every time one mounted material T or a plurality of mounted materials T are transported by the pickup roller 113, the loading unit 110 is raised. Otherwise, a position of the loading unit 110 can move up and down in accordance with a position of the pickup roller 113 in a vertical direction. Accordingly, the position of the loading unit 110 becomes a position which corresponds to a mounting amount of the mounted material T. In addition, the position of the pickup roller 113 becomes a substantially constant position with respect to the feeding roller 114. In the example illustrated in the drawing, the loading unit 110 is connected to a vertical driving axis unit 112, and as the vertical driving axis unit 112 rotates, the loading unit 110 can vertically move. The rotation of the vertical driving axis unit 112 is performed as a motor 115 which is connected to the vertical driving axis unit 112 is driven. As the vertical driving axis unit 112, for example, a lead screw is used.

In addition, an aspect of the supplying unit 10 is not particularly limited if supplying of the mounted material T mounted thereon to the manufacturing unit 102 is possible. For example, instead of the vertical driving axis unit 112, a spring which biases the loading unit 110 to the pickup roller 113 side may be provided.

As illustrated in FIGS. 2 to 4, in the supplying unit 10, the sensors 120, 122, and 124, and the detection target units 130 and 132, are provided.

The first detection target unit 130 is provided in a side unit (end unit) 111*a* of the loading unit 110. The first sensor 120 and the second sensor 122 detect the first detection target unit 130. The first sensor 120 is provided at a position which opposes the first detection target unit 130 in a state where the mounted material T is not mounted on the loading unit 110. In other words, the first sensor detects a state (paperless state) where the mounted material is not present in the loading unit 110. In addition, the second sensor 122 is provided at a position which opposes the first detection target unit 130 in a state where the mounted material T mounted thereon can be supplied and the loading unit 110 is positioned at the lowest position. In other words, the second sensor detects a state (fully mounted state) where the mounted material T having a maximum mounting amount is mounted on the loading unit 110.

The third sensor 124 detects the second detection target unit 132. The second detection target unit 132 is provided in a side unit 111*b* of the loading unit 110, protrudes upward from the loading unit 110, and has a predetermined length. The predetermined length corresponds to a thickness of the mounted material T which is 1/100 of the maximum mounting amount in the loading unit 110. In addition, the third sensor 124 is disposed at a position where the second detection target unit 132 is detected when the amount of the mounted material T in the loading unit 110 is equal to or less than 1/100 of the maximum mounting amount. As illustrated in FIG. 2, the side unit 111*b* is, for example, a side surface of the loading unit 110 which is connected (specifically, orthogonal) to the side unit 111*a*. In addition, 1/100 of the maximum mounting amount is a minimum value of a total weight of the mounted material T which can stabilizes an amount of the raw material which flows through each unit (defibrating unit 20 or deposition unit 60) of the sheet manufacturing apparatus 100. The number which is 1/100 is an example, and is a value set in advance by each sheet manufacturing apparatus. In other words, the third sensor 124 detects that the amount of the mounted material T is equal to or less than a ratio (for example, 1/100) set in advance with respect to the maximum mounting amount of the supplying unit 10. In addition, the third sensor 124 can detect the entire range which is equal to or less than the ratio set in advance. In other words, the third sensor 124 corresponds to a sensing unit which can recognize that the amount of the mounted material T is equal to or less than the ratio set in advance with respect to the maximum mounting amount of the supplying unit 10 at a plurality of points where the amount is equal to or less than the ratio set in advance. In addition, it is considered that the first sensor 120 also detects the amount which is equal to or less than 1/100 of the maximum mounting amount, but the first sensor 120 is different from the third sensor 124 in that one point which is equal to or less than 1/100 is detected by the first sensor 120.

The first sensor 120, the second sensor 122, and the third sensor 124 are provided on an inner wall of the housing 116. In addition, the first sensor 120 and the third sensor 124 are at positions which are the same in the vertical direction, and the second sensor 122 is positioned below the first sensor 120 in the vertical direction. In addition, as illustrated in FIG. 2, in a plan view, the second sensor 122 is provided to overlap with the first sensor 120. As illustrated in FIG. 2, in a plan view, the third sensor 124 is provided at a position which does not overlap with those of the sensors 120 and 122. Similarly, the first detection target unit 130 and the second detection target unit 132 are provided at positions which do not overlap with each other. The second detection target unit 132 is provided at a position which does not come into contact with the mounted material T when the mounted material T is transported.

As the first to the third sensors 120, 122, and 124, for example, a sensor which emits light toward each of the detection target units 130 and 132, and detects reflected light from the detection target units 130 and 132, is employed. In addition, aspects of the first to the third sensors 120, 122, and 124, are not particularly limited and other known aspects may be employed if the detection target units 130 and 132 can be detected. In addition, materials or shapes of the detection target units 130 and 132 are also not particularly limited if the detection target unit can be a target of detection of the first to the third sensors 120, 122, and 124. For example, as illustrated in FIGS. 3 and 4, the position of the loading unit 110 can also be detected by an encoder 119 which detects a rotation speed of the motor 115. In addition, detection is possible even when the length of the detection target unit 132 is shortened and a plurality of third sensors 124 is used. In these cases, it is not possible to detect the entire range which is equal to or less than the ratio set in advance, and the plurality of points where the amount is equal to or less than the ratio set in advance are detected. In any case, the third sensor 124 is different from the first sensor 120 which detects only one point. In addition, a part except for the entire range which is equal to or less than a ratio set in advance may be detected. In this case, when the part is not detected, it is not directly sensed, but it is possible to recognize that the part is equal to or less than the ratio set in advance. As described above, the sensing unit may be able to recognize the plurality of points where the amount is equal to or less than the ratio set in advance, and preferably, it is desirable that the entire range which is equal to or less than the ratio set in advance can be detected.

Here, the "maximum mounting amount" means the total weight of the mounted material T. In addition, when the grammage of the mounted material T is known, the "maximum mounting amount" may be the number of mounted materials T or the thickness of the mounted material T in the above-described embodiment.

1.3. Control Unit

As illustrated in FIG. 3, the control unit 140 includes an operating unit (command unit) 141, an output unit 142, a storage unit 143, and a storage medium 144, and a processing unit (determination unit) 145.

The operating unit 141 obtains an operation signal which corresponds to an operation by the user, and performs processing of sending the signal to the processing unit 145. The operating unit 141 can command the processing unit 145 to manufacture the sheet S. The operating unit 141 is, for example, a button, a key, a touch panel type display, or a microphone.

Based on the signal which is input from the processing unit 145, the output unit 142 displays a processing result or the like of the processing unit 145. The output unit 142 displays, for example, the processing result of the processing unit 145 by letters. The output unit 142 is, for example, a liquid crystal display (LCD), a cathode ray tube (CRT), or a touch panel type display. In addition, the output unit 142 may output the processing result or the like of the processing unit 145 by a sound.

The storage unit 143 stores a program or data for the processing unit 145 to perform various types of control processing. Furthermore, the storage unit 143 is used as a working area of the processing unit 145, and temporarily stores the operation signal which is input from the operating unit 141, a program or data which is read out from the storage medium 144, or a calculation result which is performed by the processing unit 145 according to the various programs.

The storage medium 144 is a storage medium which can be read by a computer for storing various types of application programs or data. In addition, the program may be delivered to the storage medium 144 (storage unit 143) via a network or the like from an information storage medium which is provided in a host device (server). The storage medium 144 may also function as a storage unit which stores data that are necessarily saved for a long time among a number of data which are generated by the processing of the processing unit 145. The storage medium 144 is realized, for example, by an optical disk (CD and DVD), a magneto-optic disk (MO), a magnetic disk, a hard disk, a magnetic tape, and a memory (ROM, flash memory, or the like).

The processing unit 145 performs various types of control processing according to the program which is stored in the storage unit 143 or the program which is stored in the storage medium 144. The processing unit 145 performs the control processing described below, for example. Functions of the processing unit 145 can be realized by various processors (CPU, DSP, or the like), hardware, such as ASIC (gate array or the like), or a program. In addition, at least a part of the processing unit 145 may be realized by hardware (dedicated circuit).

In addition, the processing unit 145 judges a situation of the mounted material T on the loading unit 110 from detection results of the first to the third sensors 120, 122, and 124. When the first sensor 120 detects the first detection target unit 130, it is judged that the mounted material T is not mounted on the loading unit 110. When the second sensor 122 detects the first detection target unit 130, it is judged that the mounted material T having the maximum mounting amount is mounted on the loading unit 110. When the third sensor 124 detects the second detection target unit 132, it is judged that the mounted material T having an amount which is equal to or greater than the predetermined weight is not mounted on the loading unit 110.

Figure 5:
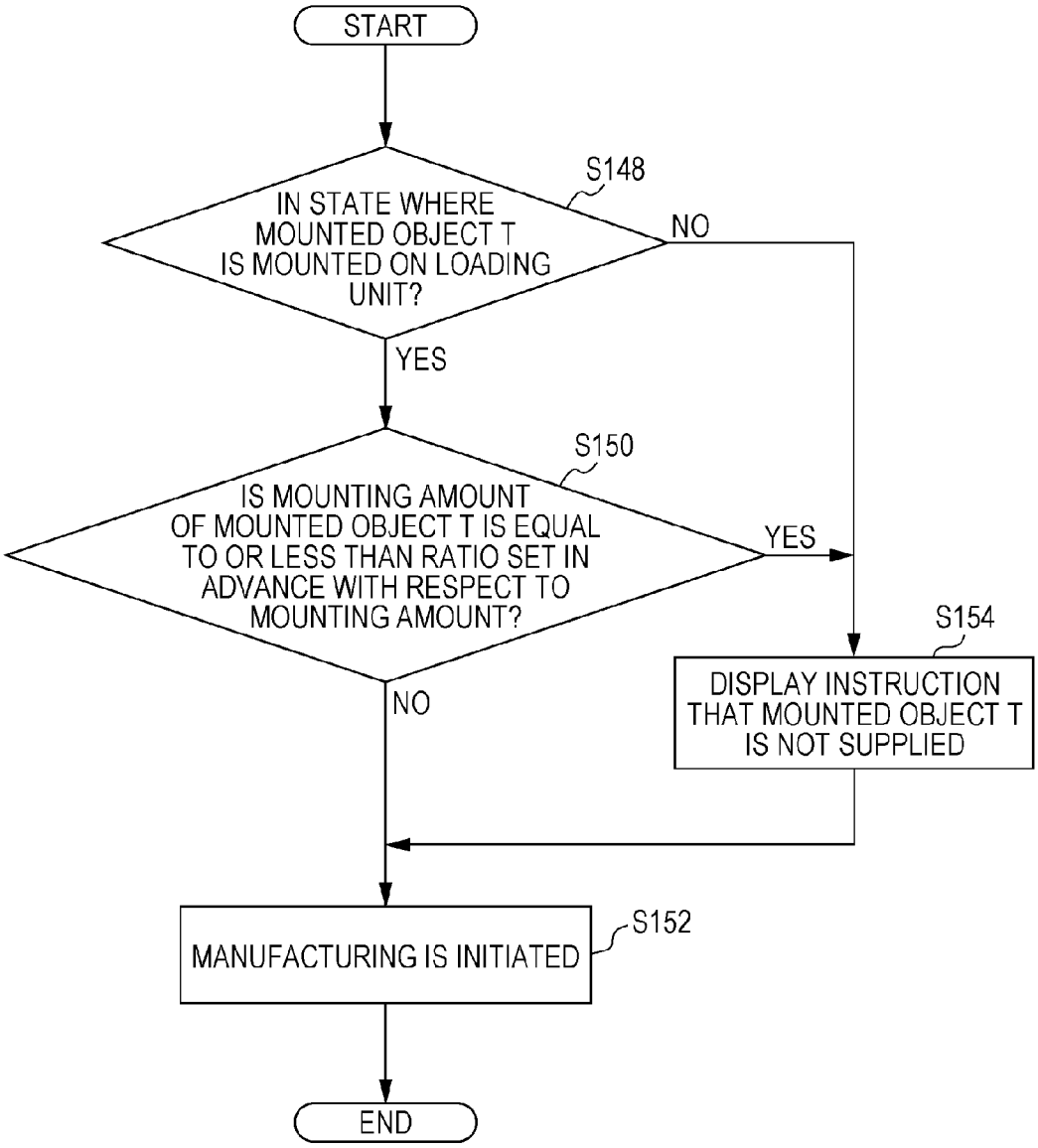
FIG. 5 is a flow chart illustrating control processing of the control unit of the sheet manufacturing apparatus according to the first embodiment.

FIG. 5 is a flow chart illustrating the control processing of the control unit 140.

For example, when the user requests processing for manufacturing the sheet S via the operating unit 141 (for example, by pressing the button), the processing unit 145 receives the operation signal from the operating unit 141, and initiates the processing. In addition, a timer is set in advance, and the processing unit 145 may receive the signal from the timer and initiate the processing.

First, based on the first sensor 120, the processing unit 145 judges whether or not the mounted material T is mounted on the loading unit 110 of the supplying unit 10 (S148). When it is judged that the mounted material T is mounted (when the first sensor 120 does not detect the first detection target unit 130, and in a case of YES in the step S148), the process moves to processing of a step S150. When it is judged that the mounted material T is not mounted (when the first sensor 120 detects the first detection target unit 130, and in a case of NO in the step S148), the process moves to a step S154. Accordingly, the processing unit 145 can judge whether or not to initiate the manufacturing of the sheet S in a state where the mounted material T is mounted on the supplying unit 10.

In the step S150, the processing unit 145 judges (determines) whether or not the mounting amount (for example, weight) of the mounted material T which is mounted on the loading unit 110 is equal to or less than the ratio (for example, equal to or less than 1/100) set in advance with respect to the maximum mounting amount. Specifically, when the third sensor 124 detects the second detection target unit 132, the processing unit 145 judges (judge the result as YES) that the total weight of the mounted material T is equal to or less than 1/100 of the maximum mounting amount, and the process moves to the step S154. When the third sensor 124 does not detect the second detection target unit 132, it is judged (judged as NO) that the total weight of the mounted material T is greater than 1/100 of the maximum mounting amount, and the process moves to a step S152.

When the processing unit 145 judges that the total weight of the mounted material T is greater than 1/100 of the maximum mounting amount (in a case of NO in the step S150), the processing unit 145 outputs the signal for manufacturing the sheet S to each unit of the sheet manufacturing apparatus 100 (S152). By considering the manufacturing of the sheet as one operation, the processing unit 145 outputs the signal for driving the motor 115 and the rollers 113 and 114 of the supplying unit 10, to the supplying unit 10. By the signal, the supplying unit 10 supplies the mounted material T to the crushing unit 12, and the manufacturing unit 102 manufactures the sheet S by using the supplied mounted material T. When the manufacturing of the sheet is ended, the processing unit 145 ends the processing.

In the step S154, the processing unit 145 outputs the signal for displaying an instruction that the mounted material T is not supplied to the output unit 142, for example. The output unit 142 receives the signal from the processing unit 145, and performs displaying of the instruction that the mounted material T is not supplied. Specifically, the output unit 142 performs displaying of the instruction that the mounted material T is not supplied by blinking and lighting of a lamp which displays an error, or by displaying characters or a picture. The output unit 142 may notify the user that the mounted material T is not supplied by a sound. In the display of the instruction that the mounted material T is not supplied, a reason thereof, such as an insufficient amount of the mounted material T, is included. Accordingly, the user can ascertain that the mounted material T is not supplied.

After this, the user replenishes the mounted material T to the supplying unit 10, and again, requests the processing for manufacturing the sheet S via the operating unit 141 (for example, by pressing the button), and then, the processing is initiated.

In the step S154, the mounted material T is not supplied, and the manufacturing of the sheet S is not performed. For this reason, the processing unit 145 determines the manufacturing of the sheet S (step S152) or not (step S154) before the step S152 (before the manufacturing of the sheet S is initiated). In addition, it is also considered that the processing unit 145 determines the manufacturing of the sheet S or not when the initiation of the manufacturing of the sheet S is commanded (when the operation signal from the operating unit 141 is received). Furthermore, after confirming that the mounted material T is present in the step S148, it is judged whether or not to manufacture the sheet S in the step S150. In other words, in a state where the mounted material T is mounted on the supplying unit 10, it is judged whether or not to initiate the manufacturing of the sheet. In addition, in the sheet manufacturing apparatus 100, in a state where the mounted material T is mounted on the supplying unit 10, when the command of manufacturing from the operating unit 141 is received, there is a case where the mounted material T is not supplied (there is a case where the processing unit 145 judges not to initiate the manufacturing).

In addition, after the processing unit 145 judges to initiate the manufacturing of the sheet S once, even when the third sensor 124 detects the second detection target unit 132, the processing unit 145 does not judge to stop the manufacturing. In other words, the processing unit 145 does not stop the output of the signal for driving the motor 115 and the rollers 113 and 114 of the supplying unit 10. Meanwhile, even after the processing unit 145 judges to initiate the manufacturing of the sheet S once, when the first sensor 120 detects the first detection target unit 130, the processing unit 145 judges to stop the manufacturing. In other words, the processing unit 145 may stop the output of the signal for driving the motor 115 and the rollers 113 and 114 of the supplying unit 10. As described above, before initiating the manufacturing of the sheet, and during the manufacturing, it is also considered that standards of judgement not to manufacture are different from each other.

The sheet manufacturing apparatus 100 has the following characteristics, for example.

In the sheet manufacturing apparatus 100, the manufacturing unit 102 which manufactures the sheet, and the supplying unit 10 which supplies the mounted material T mounted thereon to the manufacturing unit 102 are provided, and the processing unit (determination unit) 145 which judges (determines) whether or not to initiate the manufacturing of the sheet S is provided in a state where the mounted material T is mounted on the supplying unit 10. In a sheet manufacturing apparatus in the related art, it is determined whether or not the mounted material is mounted. For this reason, it is only possible to initiate the manufacturing of the sheet when the mounted material is mounted, and not to initiate the manufacturing of the sheet when the mounted material is not mounted. In other words, in the sheet manufacturing apparatus in the related art, in a state where the mounted material is mounted, determination not to initiate the manufacturing of the sheet is not performed. Meanwhile, in the sheet manufacturing apparatus 100 of the invention, in a state where the mounted material T is mounted on the loading unit 110 of the supplying unit 10, it is possible to judge not to initiate the manufacturing of the sheet S. For this reason, in the sheet manufacturing apparatus 100, it is possible to manufacture the sheet S having a stabilized grammage. Therefore, in the sheet manufacturing apparatus 100, it is possible to suppress that the sheet having desired characteristics cannot be manufactured. Accordingly, the sheet manufacturing apparatus 100 can manufacture the sheet S having desired characteristics.

In the sheet manufacturing apparatus 100, the sensing unit (third sensor 124) which can recognize that the amount of the raw material T is equal to or less than the ratio set in advance with respect to the maximum mounting amount of the supplying unit 10 at the plurality of points where the amount is equal to or less than the ratio set in advance, is provided. In the sheet manufacturing apparatus in the related art, by detecting the absence of the paper sheet, it is determined not to manufacture the sheet. In the sheet manufacturing apparatus 100 of the invention, not only when the used paper sheet is simply not present, but also when the amount of the raw material T is equal to or less than the ratio (1/100 of the maximum mounting amount) set in advance, it is possible to ascertain that the sheet S cannot be stably (for example, with a stabilized grammage) manufactured. Therefore, it is possible to determine the manufacturing of the sheet S when the amount is greater than the ratio set in advance, and to stably manufacture the sheet.

In the sheet manufacturing apparatus 100, in a state where the mounted material T is mounted on the supplying unit 10, the processing unit 145 determines not to initiate the manufacturing of the sheet S when the initiation of the manufacturing of the sheet is commanded (when the operation signal from the operating unit 141 is received) or before the manufacturing is initiated (before the step S152). In the sheet manufacturing apparatus in the related art, since the manufacturing of the sheet is initiated when the mounted material is mounted, it is determined not to manufacture the sheet when the initiation of the manufacturing of the sheet is commanded or before the manufacturing is initiated. Meanwhile, in the sheet manufacturing apparatus 100 of the invention, it is possible to determine not to manufacture the sheet when the initiation of the manufacturing of the sheet is commanded or before the manufacturing is initiated. For this reason, after the manufacturing is initiated (for example, after the crushing unit 12 crushes the mounted material T), since the manufacturing is not immediately stopped, it is possible to suppress that the mounted material T becomes wasted. In addition, in order to manufacture the sheet, regardless that the temperature of the sheet forming unit 80 is increased, by immediately stopping the manufacturing, unnecessary consumption of energy is prevented.

In the sheet manufacturing apparatus 100, the supplying unit 10 supplies the cut-form raw material T, and the manufacturing unit 102 is provided with the crushing unit 12 which crushes the raw material T. For this reason, in the sheet manufacturing apparatus 100, before the crushing unit 12 crushes the raw material T, the processing unit 145 judges whether or not to initiate the manufacturing of the sheet S. For example, when the judgement is performed after the crushing unit crushes the raw material, there is a case where it is difficult for the user to recognize which part of each unit of the sheet manufacturing apparatus that the raw material T flows up to. In the sheet manufacturing apparatus 100, it is possible to avoid such a problem.

In the sheet manufacturing apparatus 100, the output unit 142 which performs the output of the instruction (information) that the mounted material T is not supplied is provided. For this reason, the user can ascertain that the supplying unit 10 does not supply the mounted material T.

In addition, a sheet manufacturing method which uses the sheet manufacturing apparatus 100 includes: judging (determining) whether or not to initiate the manufacturing of the sheet S by the processing unit (determination unit) 145 in a state where the mounted material T is mounted on the supplying unit 10; supplying the mounted material T mounted thereon to the manufacturing unit; and manufacturing the sheet S by using the supplied mounted material T. For this reason, in the sheet manufacturing method which uses the sheet manufacturing apparatus 100, it is possible to manufacture the sheet S having desired characteristics.

Second Embodiment

2. Sheet Manufacturing Apparatus

Figure 6:
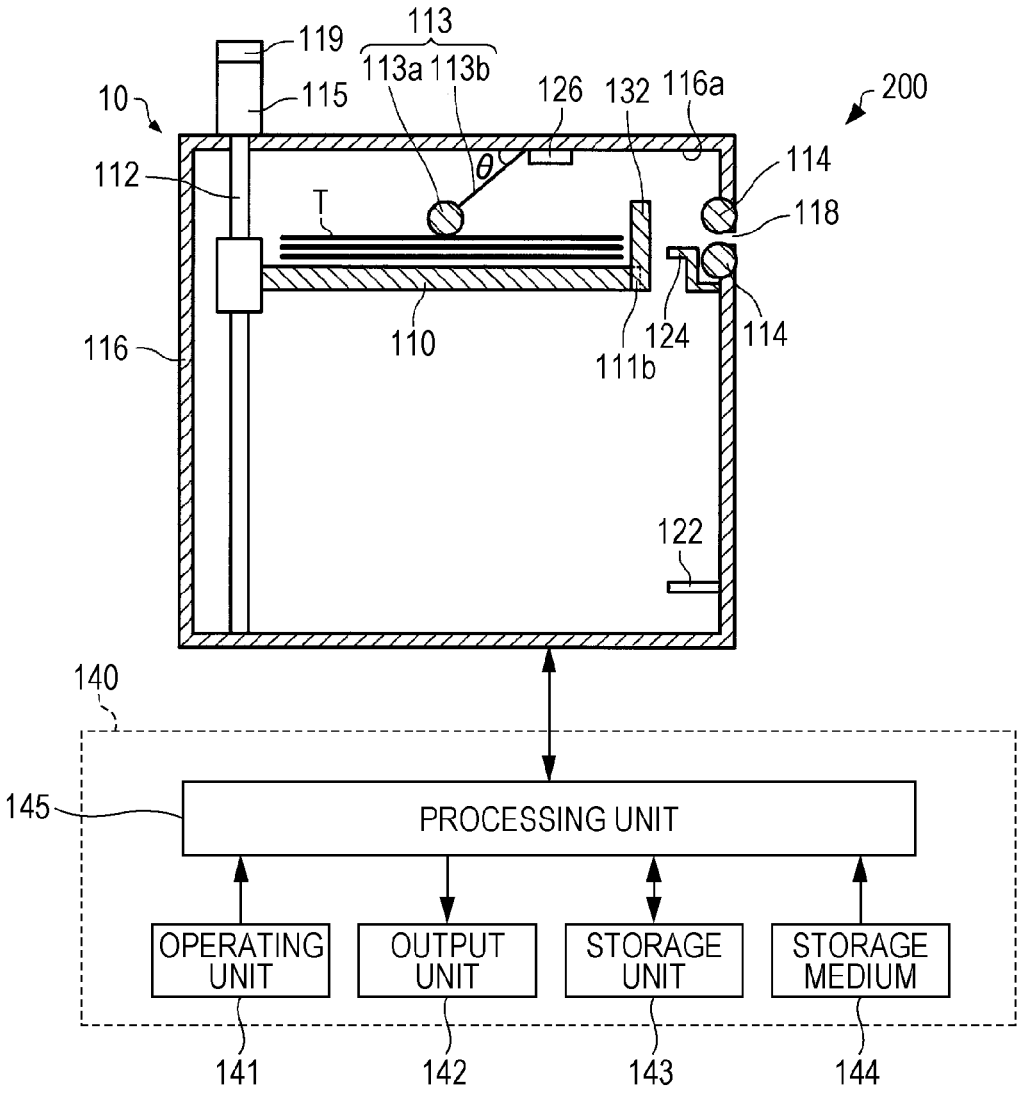
FIG. 6 is a view illustrating a supplying unit and a control unit of a sheet manufacturing apparatus according to a second embodiment.

Next, a sheet manufacturing apparatus according to a second embodiment will be described with reference to the drawings. FIG. 6 is a schematic sectional view illustrating the supplying unit 10 of a sheet manufacturing apparatus 200 according to the second embodiment, and illustrates the same sectional view as that of FIG. 4. In addition, in FIG. 6, a functional block diagram of the control unit 140 is also illustrated. Hereinafter, in the sheet manufacturing apparatus 200, the content which is different from that of the example of the above-described sheet manufacturing apparatus 100 will be described, and the description of the similar content will be omitted.

As illustrated in FIG. 6, the supplying unit 10 of the sheet manufacturing apparatus 200 is different from the supplying unit 10 of the above-described sheet manufacturing apparatus 100 in that a fourth sensor 126 is provided.

Figure 7:
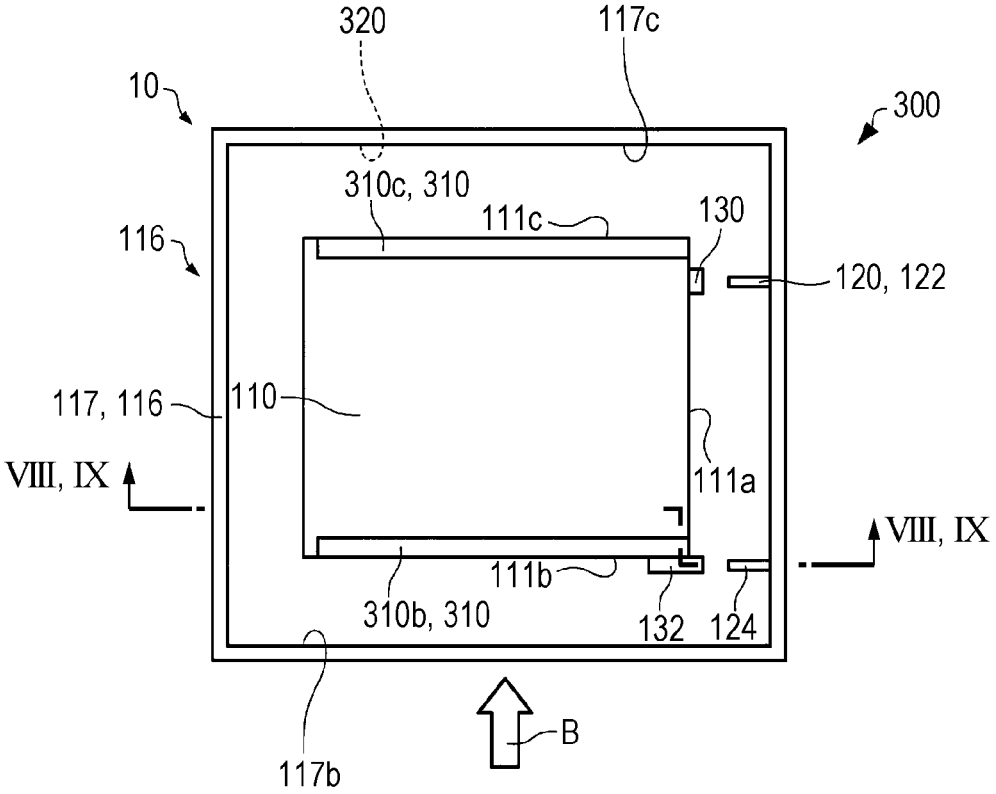
FIG. 7 is a schematic plan view of a sheet manufacturing apparatus according to a third embodiment.
Figure 8:
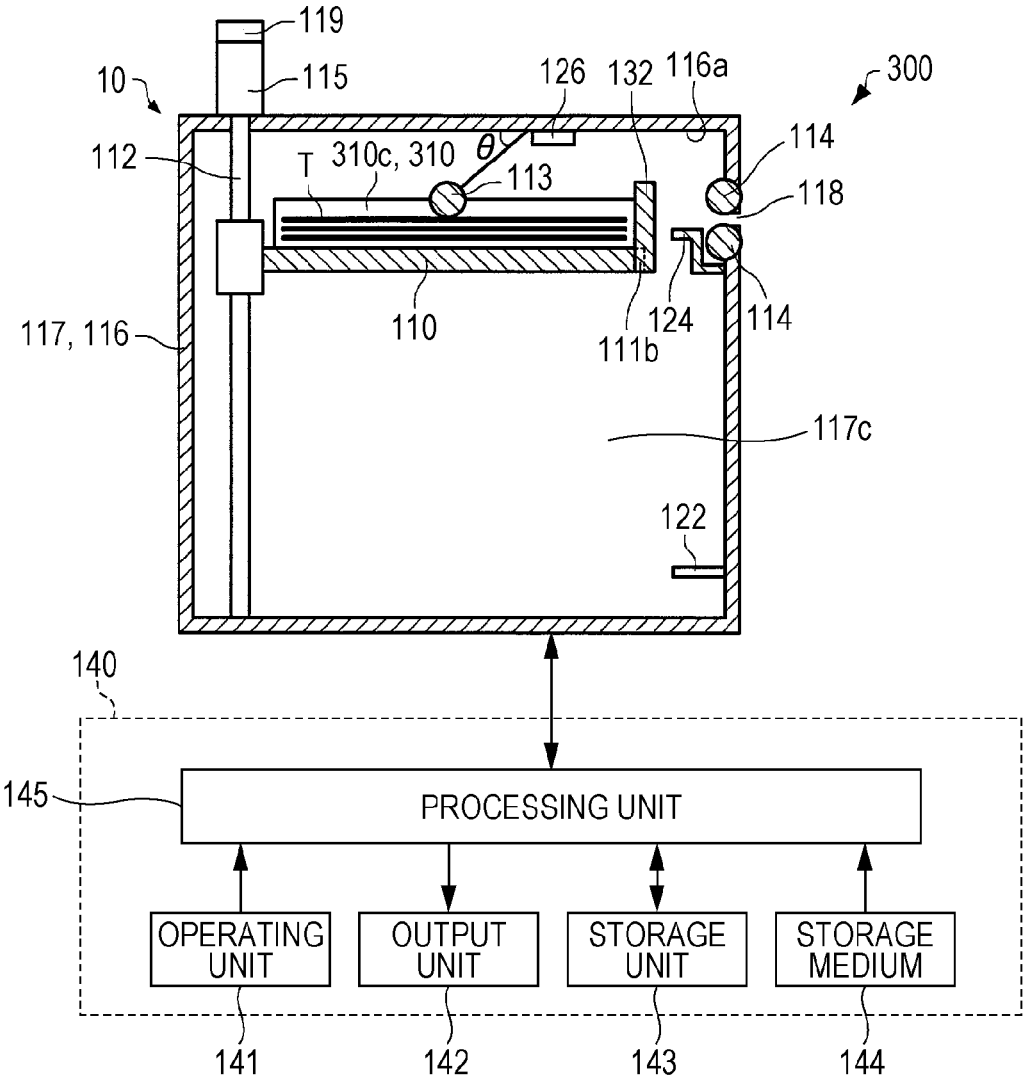
FIG. 8 is a view illustrating a supplying unit and a control unit of the sheet manufacturing apparatus according to the third embodiment.

The fourth sensor 126 is adjacent, for example, to the pickup roller 113, and is provided on an inner upper surface 116*a* of the housing 116. As illustrated in FIGS. 7 and 8, the pickup roller 113 includes a roller unit 113*a*, and a supporting unit 113*b* which supports the roller unit 113*a* and is connected to the inner upper surface 116*a*. In a state where the roller unit 113*a* abuts against the mounted material T, when the loading unit 110 moves (raised or lowered), a connection angle θ between the supporting unit 113*b* and the inner upper surface 116*a* changes. The fourth sensor 126 can detect the connection angle θ. The aspect or the position of the fourth sensor 126 is not limited if the connection angle θ can be detected.

In the sheet manufacturing apparatus 200, in the step S154 illustrated in FIG. 5, when the processing unit 145 outputs the signal for displaying the instruction that the mounted material T is not supplied to the output unit 142, the processing unit 145 computes the number of mounted materials T on the loading unit 110 from the connection angle θ which is detected by the fourth sensor 126, and outputs the signal for displaying the instruction (information) on how many mounted materials T are supposed to be additionally mounted to initiate the manufacturing of the sheet (supply of the mounted material T), to the output unit 142. Accordingly, the output unit 142 performs the output of the display of the instruction (information) on how many mounted materials T are supposed to be additionally mounted to initiate the manufacturing of the sheet (supplying of the mounted material T). Based on the display of the output unit 142, the user may mount the mounted material T to the loading unit 110. However, since there is a case where the number calculated by the processing unit 145 is different from the number which is actually necessary for initiating the manufacturing of the sheet, for example, due to the thickness or the like of the mounted material T, the user may mount more mounted materials T than the number displayed by the output unit 142 onto the loading unit 110.

In addition, above, the fourth sensor 126 detects the connection angle θ, but the target to be detected by the fourth sensor 126 is not particularly limited if the processing unit 145 can compute the number of mounted materials T on the loading unit 110 based on the detection result of the fourth sensor 126. For example, the fourth sensor 126 may be a sensor which detects the number of revolution of the motor 115, and may be a reflection type optical sensor which detects the position of the uppermost mounted material T among the loaded mounted materials T.

In the sheet manufacturing apparatus 200, as described above, the output unit 142 performs the output of the instruction (information) on how many mounted materials T are supposed to be additionally mounted to initiate the manufacturing of the sheet. For this reason, the user can ascertain how many mounted materials T are supposed to be additionally mounted to initiate the manufacturing of the sheet.

Third Embodiment

3. Sheet Manufacturing Apparatus

Figure 9:
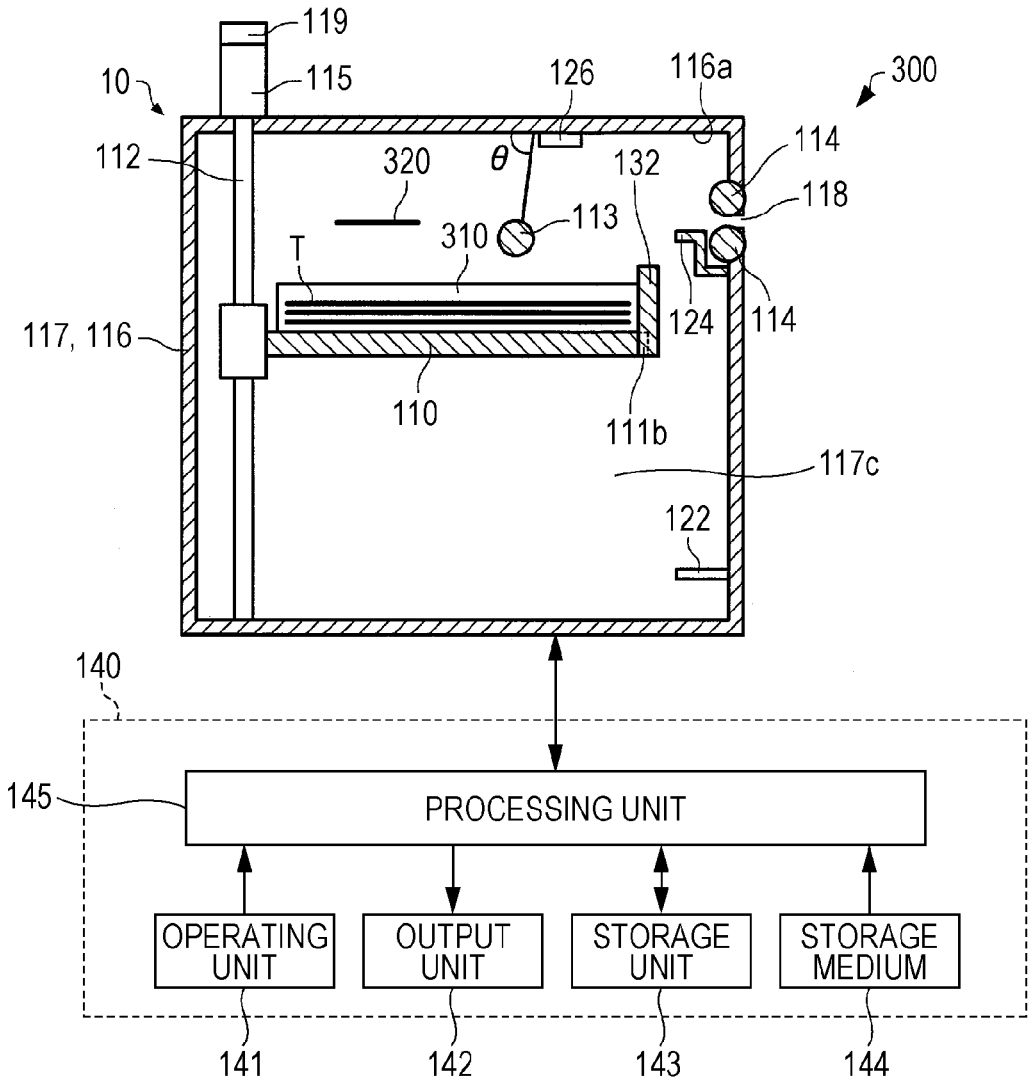
FIG. 9 is a view illustrating the supplying unit and the control unit of the sheet manufacturing apparatus according to the third embodiment.

Next, a sheet manufacturing apparatus according to a third embodiment will be described with reference to the drawings. FIG. 7 is a schematic view of the supplying unit 10 of a sheet manufacturing apparatus 300 according to the third embodiment. FIGS. 8 and 9 are sectional views along line VIII-VIII and line IX-IX of FIG. 7 schematically illustrating the supplying unit 10 of the sheet manufacturing apparatus 300 according to the third embodiment. In addition, for convenience, in FIG. 7, parts except for the loading unit 110, a side wall unit 117 of the housing 116, the sensors 120, 122, and 124, the detection target units 130 and 132, and a side plate 310 are omitted. In addition, in FIG. 8, a state where the third sensor 124 detects the second detection target unit 132 is illustrated, and in FIG. 9, a state where the loading unit 110 illustrated in FIG. 8 is lowered and the third sensor 124 does not detect the second detection target unit 132 is illustrated. In addition, in FIGS. 8 and 9, functional block diagrams of the control unit 140 is illustrated. Hereinafter, in the sheet manufacturing apparatus 300, the content which is different from that of the example of the above-described sheet manufacturing apparatuses 100 and 200 will be described, and the description of the similar content will be omitted.

As illustrated in FIGS. 7 to 9, the supplying unit 10 of the sheet manufacturing apparatus 300 is different from the supplying unit 10 of the above-described sheet manufacturing apparatus 100 in that the fourth sensor 126, the side plate 310, and a reference unit 320 are provided.

The side plate 310 is connected to the loading unit 110. The side plate 310 is a plate which extends upward from the loading unit 110. The height (length in the vertical direction) of the side plate 310 is, for example, less than the height of the second detection target unit 132, and equal to or greater than the thickness of the mounted materials T having a necessary number for initiating the manufacturing of the sheet. The side plate 310 may be provided integrally with the loading unit 110. In the example illustrated in FIG. 7, a side plate 310*b* which has a side surface that continues to the side unit 111*b* of the loading unit 110 and a side plate 310*c* which has a side surface that continues to a side unit 111*c* (surface which faces a side opposite to the side unit 111*b*) of the loading unit 110, are provided. In addition, although not illustrated in the drawings, any one of the side plate 310*b* and the side plate 310*c* may not be provided.

The reference unit 320 is provided on an inner surface 117*c* of the side wall unit 117 which constitutes the housing 116. The inner surface 117*c* is, for example, a surface which opposes the side unit 111*c*. When viewed from an arrow B direction illustrated in FIG. 7 (when the side unit 111*c* side is viewed from the side unit 111*b* side), as illustrated in FIG. 8, in a state where the third sensor 124 detects the second detection target unit 132, the reference unit 320 is provided at a position which overlaps with the side plate 310. In other words, when viewed from the arrow B direction, in a state illustrated in FIG. 8, since the reference unit 320 is hidden by the side plate 310, the user cannot see the reference unit 320.

The reference unit 320 describes, for example, an instruction (indicator) which illustrates a reference of a loading amount of the mounted material T which is necessary for initiating the manufacturing of the sheet (supply of the mounted material T). In the example illustrated in FIG. 9, the reference unit 320 is a line which is drawn on the inner surface 117*c*, but not particularly limited thereto. For example, the reference unit 320 may be a cutout or a protruded or recessed part on the inner surface 117*c*, and may have the words "Please load the used paper sheet above here" written on the inner surface 117*c*. Otherwise, the reference unit 320 may also be configured of a line and words which are "Please load the used paper sheet above here" written below the line. However, when the reference unit 320 is only a line, since the user does not ascertain the purpose of the line, it is preferable that the reference unit 320 includes the words "Please load the used paper sheet above here".

In the sheet manufacturing apparatus 300, in the step S154 illustrated in FIG. 5, after the output unit 142 outputs the display of the instruction that the mounted material T is not supplied, when the user loads the mounted material T onto the loading unit 110, the user can ascertain the necessary loading amount (number of loaded materials) of the mounted material T by the reference unit 320. Specifically, in a state illustrated in FIG. 8, the output unit 142 outputs the display of the instruction that the mounted material T is not supplied. In addition, when the user presses, for example, a button for lowering the loading unit 110, the loading unit 110 is lowered to a predetermined position where the third sensor 124 does not detect the second detection target unit 132, and become a state illustrated in FIG. 9. In a state illustrated in FIG. 9, the user can visually recognize the reference unit 320, and can load the mounted material T exceeding the reference unit 320. After this, as the user presses, for example, a button or the like for initiating the supply of the mounted material, based on the detection result of the fourth sensor 126, the processing unit 145 moves (raises or lowers) the loading unit 110 until the connection angle θ becomes a predetermined angle. In this state, the third sensor 124 does not detect the second detection target unit 132, and the supply of the mounted material T is initiated (the process moves to the step S152 illustrated in FIG. 5).

In addition, when the user desires to load a large amount of the mounted materials T, for example, by pressing the button (not illustrated) which is provided in the supplying unit 10, the user can load the mounted material T after further lowering the loading unit 110. In this manner, the loading unit 110 can be gradually lowered.

In addition, due to some reason, when the user presses the button for initiating the supply of the mounted material regardless that the mounted material T is not loaded exceeding the reference unit 320, based on the detection result of the fourth sensor 126, after the processing unit 145 raises the loading unit 110 until the connection angle θ becomes the predetermined angle, the third sensor 124 detects the second detection target unit 132. In addition, the processing unit 145 outputs the signal again for displaying the instruction that the mounted material T is not supplied to the output unit 142.

In the sheet manufacturing apparatus 300, as described above, the reference unit 320 is provided in the supplying unit 10. For this reason, the user can ascertain the loading amount of the mounted material T which is necessary for initiating the manufacturing of the sheet.

Furthermore, in the sheet manufacturing apparatus 300, the side plate 310 is connected to the loading unit 110, and the height of the side plate 310 is less than the height of the second detection target unit 132 and is equal to or greater than the thickness of the mounted material T having the necessary number for initiating the manufacturing of the sheet. For example, when the side plate 310 is not provided, according to the position of the loading unit 110, there is a case where the loading amount of the mounted material T which is necessary for initiating the manufacturing of the sheet is not achieved regardless that the amount of the mounted material T exceeds the reference unit 320. In the sheet manufacturing apparatus 300, as the side plate 310 is provided, it is possible to avoid such a problem.

In addition, although not illustrated, the reference unit 320 may be provided on an inner surface 117*b* (surface which opposes the inner surface 117*c*) of the housing 116 instead of the inner surface 117*c* of the housing 116, and may be provided on both the inner surface 117*b* and the inner surface 117*c*.

Figure 10:
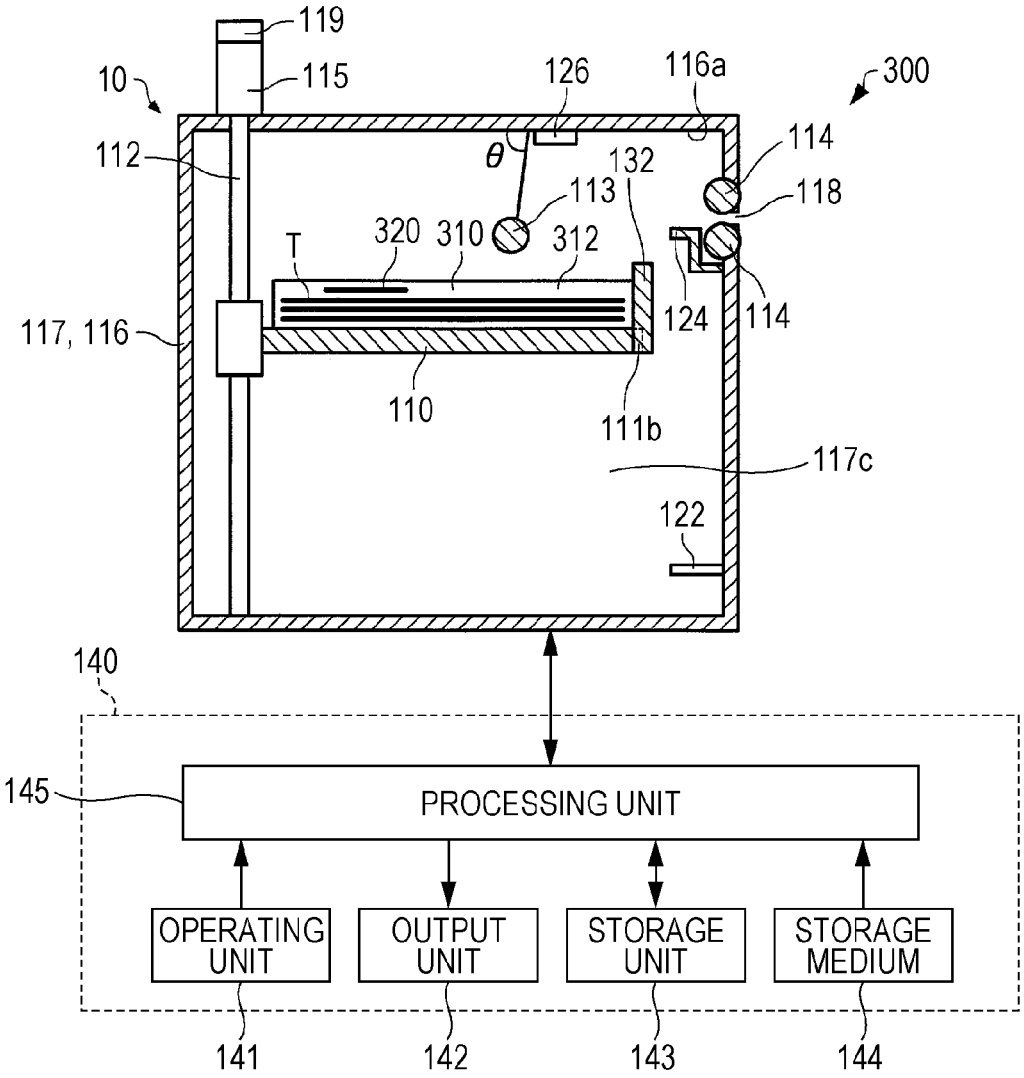
FIG. 10 is a view illustrating the supplying unit and the control unit of the sheet manufacturing apparatus according to the third embodiment.

In addition, as illustrated in FIG. 10, the reference unit 320 may be provided on a side surface 312 of the side plate 310. In this aspect, for example, even when the loading unit 110 is in a state of being lowered down to a lowermost position, the user can load the mounted material T as many as a minimum number which is necessary for initiating the manufacturing of the sheet. In addition, on the side surface 312, the side plate 310*c* is a surface which faces the side plate 310*b* side, and the side plate 310*b* is a surface which faces the side plate 310*c* side.

In addition, the sheet S which is manufactured by the sheet manufacturing apparatus according to the invention mainly indicates a manufactured product which has a shape of a sheet. However, the shape thereof is not limited to the shape of a sheet, and may have a shape of a board or a web. The sheet of the specification is divided into a paper sheet and non-woven fabric. The paper sheet includes a paper sheet which is formed in a shape of a thin sheet by using pulp or used paper sheet as a raw material, and includes recording paper for writing or printing, wall paper, wrapping paper, colored paper, drawing paper, or Kent paper. The non-woven fabric is thicker than the paper sheet, has a lower strength than that of the paper sheet, and includes general non-woven fabric, a fabric board, tissue paper (tissue paper for cleaning), paper towel, a cleaner, a filter, a liquid (waste ink or oil) absorbent, a sound absorbing material, a heat insulating material, a cushioning material, or a matting material. In addition, as the raw material, vegetable fibers, such as cellulose, chemical fibers, such as polyethylene terephthalate (PET) or polyester, or animal fibers, such as wool or silk, may be employed.

The invention may omit a part of the configuration within the range of the characteristics or the effects described in the specification, and may combine each embodiment or modification examples. In addition, the manufacturing unit 102 may omit a part of the configuration within the range where the sheet can be manufactured, may add another configuration, and may switch a part of the configuration to a known configuration. In the embodiment, a dry type sheet manufacturing unit is illustrated, but a wet type may also be employed.

The invention includes substantially the same configuration (a configuration which has the same functions, methods, and effects, or a configuration which has the same purpose and effects) as the configuration described in the embodiment. In addition, the invention includes a configuration in which a part which is not essential to the configuration described in the embodiments is switched. In addition, the invention includes a configuration which can achieve the same operation effects or the same purpose as those of the configuration described in the embodiments. In addition, the invention includes a configuration in which a known technology is added to the configuration described in the embodiments.

The entire disclosure of Japanese Patent Application No.: 2014-180857, filed Sep. 5, 2014 and 2014-243669, filed Dec. 2, 2014 are expressly incorporated by reference herein.

What is claimed is:

1. A sheet manufacturing apparatus, comprising:

a manufacturing unit configured to manufacture a sheet of paper from a raw material;

a supplying unit configured to supply a raw material mounted thereon to the manufacturing unit;

a first sensor configured to detect whether or not the raw material is mounted; and a second sensor configured to detect whether or not an amount of the mounted raw material is equal to or less than a ratio set in advance with respect to a maximum mounting amount of the supplying unit when the first sensor detects that the raw material is mounted;

wherein when the first sensor detects that the raw material is not mounted, a manufacturing of the sheet is not started, and wherein when the first sensor detects that the raw material is mounted and the second sensor detects that the amount of the mounted raw material is not equal to or less than the ratio set in advance with respect to the maximum mounting amount of the supplying unit, the manufacturing of the sheet is started.

2. The sheet manufacturing apparatus according to claim 1, wherein the second sensor detects whether or not the amount of the mounted raw material is equal to or less than the ratio set in advance with respect to the maximum mounting amount of the supplying unit at a plurality of points where the amount is equal to or less than the ratio set in advance.

3. The sheet manufacturing apparatus according to claim 1, further comprising:

a determination unit configured to determine whether or not to initiate the manufacturing of the sheet, wherein the determination unit determines not to initiate the manufacturing of the sheet when initiation of the manufacturing of the sheet is commanded or before the manufacturing is initiated in a state where the raw material is mounted on the supplying unit.

4. The sheet manufacturing apparatus according to claim 1, wherein the supplying unit supplies a cut-form raw material, and a crushing unit crushes the raw material.

5. The sheet manufacturing apparatus according to claim 1, further comprising:

an output unit configured to output information on how many raw materials are supposed to be additionally mounted to initiate the manufacturing of the sheet.

6. The sheet manufacturing apparatus according to claim 1, wherein an indicator which shows a reference of a loading amount of the raw material which is necessary for initiating the manufacturing of the sheet is provided on the supplying unit.

7. A sheet manufacturing method, comprising:

detecting a presence or absence of the raw material mounted thereon by a first sensor;

detecting that an amount of the mounted raw material is not equal to or less than a ratio set in advance with respect to a maximum mounting amount of the supplying unit when the first sensor detects the presence of the mounted raw material;

determining whether or not to initiate manufacturing of a sheet of paper using the raw material by a determination unit in a state where the raw material is mounted on a supplying unit;

supplying the mounted raw material to a manufacturing unit from the supplying unit;

initiating manufacturing of the sheet; and manufacturing the sheet by using the supplied raw material.

8. A sheet manufacturing apparatus, comprising:

a manufacturing unit configured to manufacture a sheet;

a supplying unit configured to supply a raw material mounted thereon to the manufacturing unit;

a first sensor configured to detect a presence or absence of the mounted raw material; and a second sensor configured to detect whether or not an amount of the mounted raw material is equal to or less than a ratio set in advance with respect to a maximum mounting amount of the supplying unit when the first sensor detects the presence of the raw material; and a command unit configured to initiate manufacturing of the sheet based on a detection result of the second sensor in a state where the raw material is mounted on the supplying unit, wherein there is a case where the mounted raw material is not supplied when a command to initiate manufacturing is received from the command unit in a state where the mounted raw material is mounted on the supplying unit.

9. The sheet manufacturing apparatus according to claim 8, further comprising:

an output unit configured to output information that the mounted raw material is not supplied.

10. The sheet manufacturing apparatus according to claim 9, wherein the output unit performs outputting of information on how many raw materials are supposed to be additionally mounted to initiate manufacture of the sheet.

11. The sheet manufacturing apparatus according to claim 8, wherein an indicator which shows a reference of a loading amount of the raw material which is necessary for initiating the supply of the mounted raw material is provided on the supplying unit.

12. The sheet manufacturing apparatus according to claim 8, wherein when the first sensor detects that the raw material is mounted and the second sensor detects that the amount of the mounted raw material is equal to or less than the ratio set in advance with respect to the maximum mounting amount of the supplying unit, the manufacturing of the sheet is not started.

* * * * *